United States Patent [19]

Edstrom et al.

[11] 3,961,862

[45] June 8, 1976

[54] COMPRESSOR CONTROL SYSTEM

[75] Inventors: Soren E. H. Edstrom; Richard L. Ertel; Robert A. Litteken, all of Quincy, Ill.

[73] Assignee: Gardner-Denver Company, Dallas, Tex.

[22] Filed: Apr. 24, 1975

[21] Appl. No.: 571,179

[52] U.S. Cl. ..... 417/282; 417/290; 417/275; 418/87; 417/292; 417/309

[51] Int. Cl.[2] ..... F04B 49/00; F04B 49/02

[58] Field of Search ..... 417/282, 290, 292, 295, 417/300

[56] References Cited

UNITED STATES PATENTS

| | | | |
|---|---|---|---|
| 2,613,026 | 10/1952 | Barks | 417/295 |
| 2,977,039 | 3/1961 | Green et al. | 417/228 |
| 3,186,631 | 6/1965 | Lamberton et al. | 417/295 X |
| 3,260,444 | 7/1966 | Williams | 417/295 X |
| 3,602,610 | 8/1971 | Bloom | 417/282 X |
| 3,653,191 | 4/1972 | Nelson | 417/295 X |
| 3,788,776 | 1/1974 | Post et al. | 417/295 |

*Primary Examiner*—Carlton R. Croyle
*Assistant Examiner*—Richard E. Gluck
*Attorney, Agent, or Firm*—Michael E. Martin

[57] ABSTRACT

A positive displacement rotary compressor is in circuit with a closable chamber disposed upstream of the compressor gas inlet and including a conduit operable to be placed in communication with the compressor discharge conduit. A control circuit is operable to sense compressor discharge pressure and at a predetermined pressure condition sequentially operate valves to shut off compressor inlet flow thereby evacuating the chamber and then placing the compressor discharge port in communication with the chamber. The compressor thereby runs unloaded or at idle at a greatly reduced inlet and discharge pressure. The operation of unloading the compressor may be controlled by sensing the chamber vacuum or by the use of time delay devices.

13 Claims, 5 Drawing Figures

COMPRESSOR CONTROL SYSTEM

BACKGROUND OF THE INVENTION

In the art of rotary, positive displacement gas compressors, including sliding vane and helical screw types, it is conventional practice to unload the compressor while running at constant speed by throttling the compressor inlet to reduce or shut off inlet gas flow. Such a method of compressor unloading has proved to be simple and reliable but has the disadvantage that power consumption of the compressor while running unloaded or at idle is quite high often on the order of 60–80 percent of full load power consumption. This high power input required during unloaded running is due to the compressor continuing to compress or work against high pressure in the compressor discharge conduit and in the working chambers of the compressor. Internal leakage into the compression chambers of fluid flowing back from the discharge port causes continual recompression thereby requiring substantial power input to the compressor. Moreover, it is usually necessary in compressors which are liquid injected to continue to inject liquid at a substantial rate during unloaded operation to prevent heat buildup from the constant recompression of the working fluid in the compressor. This high liquid injection rate increases the pumping work done by the compressor as well as contributes to the cooling load on the compressor unit at unloaded conditions.

Previous attempts to provide improved control systems for unloading rotary compressors include systems which reduce back pressure in the discharge line by venting the line to atmospheric pressure either by blowing down the reservoir tank downstream of the compressor or by venting the compressor discharge line into an auxiliary receiver at atmospheric pressure. Such systems usually include shutting off of inlet gas flow while the discharge side of the compressor is vented to atmosphere. Such systems have the disadvantage that considerable power is required to compress the gas that backflows into the compressor from the discharge line even though the gas pressure in the discharge port and passages is reduced to atmospheric pressure. Power requirements of such systems during unloaded operation are often on the order of 25 percent of full load power assuming an air compressor working to compress from atmospheric pressure to a discharge pressure of 100 p.s.i. (7.03 Kg/cm$^2$). U.S. Pat. No. 2,977,039 to W. E. Green et al. and U.S. Pat. No. 3,186,631 to R. E. Lamberton et al. disclose systems generally of the above mentioned type.

U.S. Pat. No. 3,260,444 to R. F. Williams et al. discloses an unloading control system for a liquid injected helical screw compressor in which a pump is connected to the compressor discharge conduit during unloaded operation for evacuating the gas and liquid in the discharge line between a downstream check valve and the compressor proper. In this type of system it is possible to substantially evacuate the compressor discharge conduit and working chambers. However, the system does require sufficient liquid injection to keep the pump sealed, cooled, and lubricated. The amount of liquid needed to maintain proper operation of the pump has generally been in excess of the amount required to lubricate the compressor bearings and rotors and has been found to cause undesirable noise and vibration when injected into the compressor in the manner and quantities required for the Williams et al system. Moreover, the pump itself is not always required for furnishing injection liquid in some compressor systems and therefore in such systems the pump becomes an extra cost item as part of the unloading system.

Accordingly, it has been deemed desirable to provide a compressor control system for unloading gas compressors including liquid injected positive displacement compressors wherein the back pressure or working pressure in the discharge port and the compressor working chambers may be reduced as much as possible without continued injection of copious amounts of liquid and without requiring auxiliary pumping devices.

SUMMARY OF THE INVENTION

The present invention provides an improved unloading control system for a gas compressor apparatus wherein the compressor may be run in the idling or no-gas delivery mode at very low power input to the compressor. In accordance with the present invention there is provided an unloading system for a compressor apparatus wherein an auxiliary chamber is evacuated by the pumping action of the compressor itself and then is placed in communication with the compressor discharge port whereby the compressor operates to pump a very small mass flow of fluid during unloaded operation. Furthermore, the compressor unloading control system of the present invention operates a compressor of the positive displacement rotary type at very low discharge pressures, which for an air compressor working with atmospheric inlet air may be substantially below atmospheric pressure during unloaded operation.

The unloading control system of the present invention also provides for operating a liquid injected rotary compressor in the unloaded or idling mode for extended periods without continuous injection of liquid into the compressor proper during unloaded operation. Accordingly, liquid foaming and the associated noise and vibration experienced with prior art unloading control systems are avoided. Moreover, with the compressor unloading control system of the present invention auxiliary pumping devices and liquid metering valves required in some prior art systems are eliminated.

The compressor unloading control system of the present invention further provides for maintaining the compressed gas receiver and liquid reservoir at normal compressor discharge or delivery pressure during unloaded operation thereby improving the operating efficiency of the compressor apparatus.

The above noted as well as other superior features of the unloading control system of the present invention are believed to be realizable to those skilled in the art upon reading the detailed description of the preferred embodiments herein.

DESCRIPTION OF THE PREFERRED EMBODIMENTS

Referring to FIGS. 1 through 4, two embodiments of an unloading control system for a liquid injected helical screw air compressor are shown in schematic form. The symbols representing various components in the schematics of FIGS. 1 through 4 are generally in conformity with U.S.A. Standards for graphic symbols for fluid power and electrical diagrams. The physical form of some of the components may be varied in actual practice and some components may be combined or provided separately to perform the intended function represented by the symbols of FIGS. 1 through 4. Moreover, although the disclosed embodiments of the unloading control system of the present invention are well suited for use with a liquid injected helical screw type compressor it is anticipated that compressors including rotary vane, as well as other positive displacement types may be used in conjunction with the systems disclosed herein. The control systems of the present invention may also be adapted for compressors working with gases other than air, namely, refrigerant vapors and the like.

Figure 1:
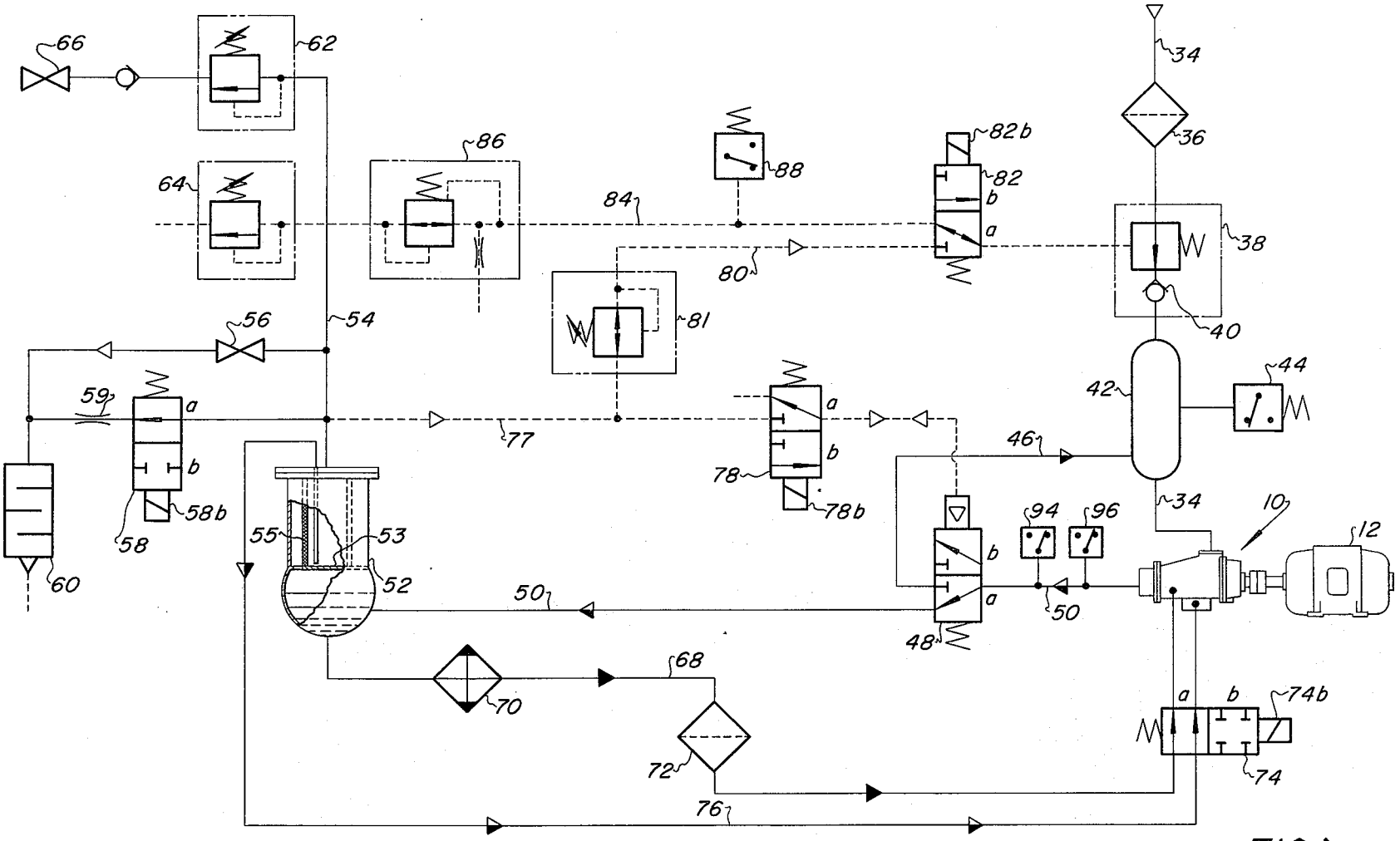
FIG. 1 is a schematic diagram of a compressor apparatus including one embodiment of the unloading control system of the present invention.
Figure 2:
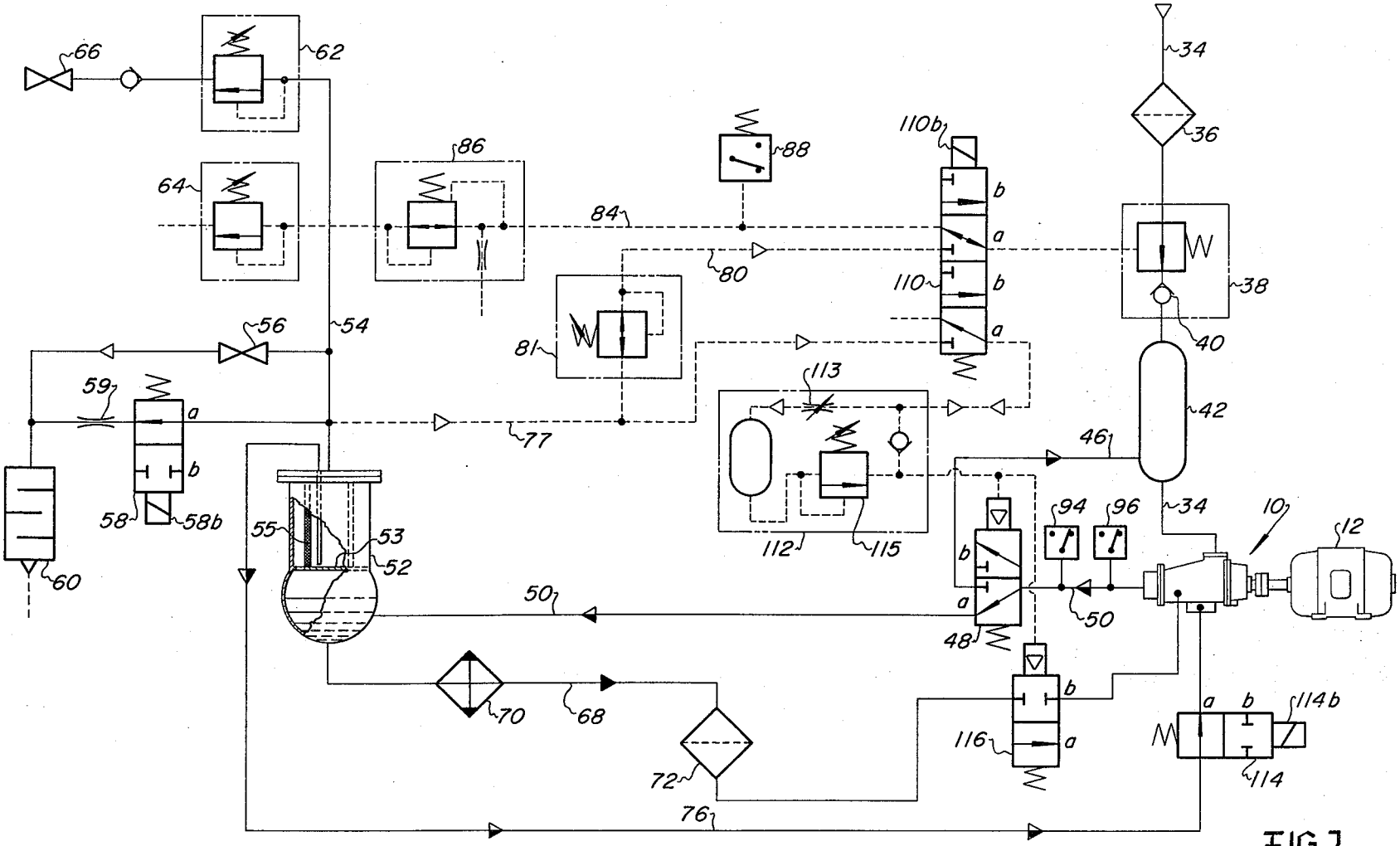
FIG. 2 is a schematic diagram of another embodiment of the unloading control system of the present invention.
Figure 5:
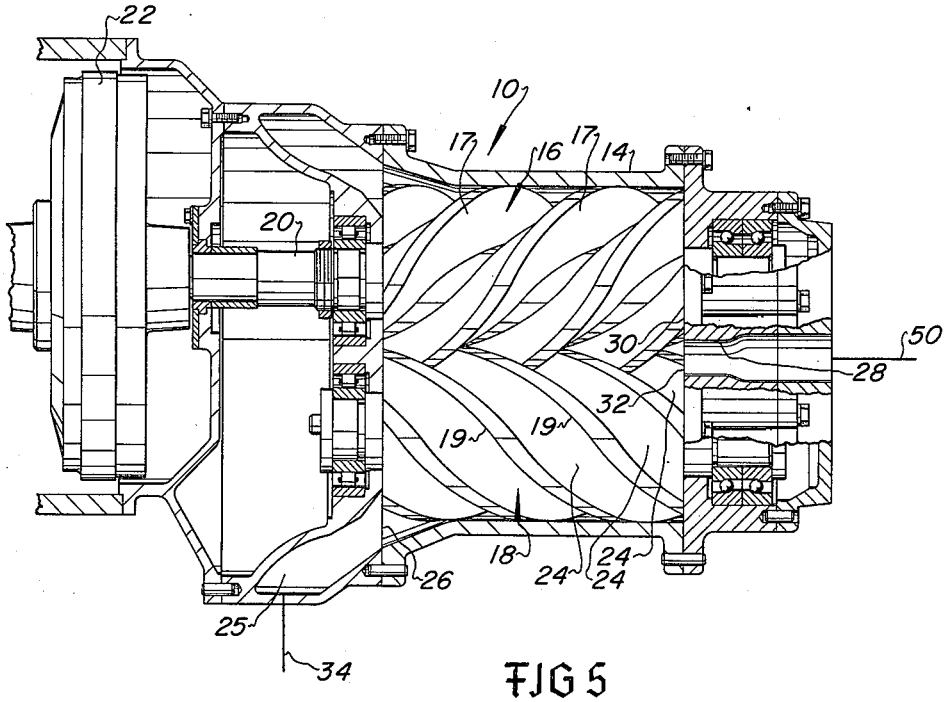

The control systems of FIGS. 1 and 2 include a liquid injected helical screw compressor generally designated by the numeral 10. The compressor 10 is suitably connected to a prime mover such as an electric motor 12 to be rotatably driven thereby. Referring to FIG. 5, the compressor 10 is characterized by a housing 14 having a pair of intersecting parallel bores in which are rotatably disposed a pair of intermeshing helical lobed rotors 16 and 18. The rotor 16 includes a shaft portion 20 which is adapted to be driven by the motor 12 through a gear drive 22. In a known way the main rotor 16, which has a plurality of helical convex lobes 17, meshes with grooves formed by flutes 19 on the gate rotor 18 to provide a series of moving chambers 24 which decrease in volume as the rotors rotate to thereby compress gas entrapped in the chambers. The compressor 10 also includes an interior space 25 which communicates with an inlet port 26 for admitting gas to the chambers 24. The inlet port 26 is normally defined as the opening in the side or end wall of housing 14 which admits working fluid directly to the chambers formed by the intermeshing rotors 16 and 18. A discharge passage 28 opens through an end wall 30 of the housing 14 thereby forming a port 32 for conducting compressed gas from the compressor proper. The compressor 10 is of a well known type which is characterized in having means for injecting liquid such as oil directly into the interior of the housing for sealing the clearance spaces between the housing and the rotors themselves. Suitable conduit means, not shown, are provided for circulating injection liquid to the rotor bearings and then into the rotor chamber. The injected liquid also mixes with the gas being compressed and is conducted out through the discharge passage 28 and through a suitable discharge conduit to a liquid separator and reservoir.

As shown in FIG. 1, the control system includes compressor inlet conduit means 34 which is adapted to be in communication with the compressor inlet port 26. An inlet air filter 36 and a pneumatic or pilot pressure operated compressor inlet valve 38 are disposed in the conduit means 34. The inlet valve 38 is shown as a normally open valve infinitely positionable between open and closed positions. The valve 38 may also include a check valve 40 or be formed to act as a check valve in the manner indicated in FIG. 1. The valve 38 may take various forms but is basically operable to be moved toward a closed condition in response to receiving a control signal. Also interposed in the conduit means 34 is a chamber 42 which may be formed as part of the conduit means 34, as part of the compressor inlet in the vicinity of the port 26, or as a separate vessel as shown in FIGS. 1 and 2. A pressure operated or so-called vacuum switch 44 is in communication with the chamber 42, and a conduit 46 leading from a two-position pilot operated valve 48 is also in communication with the chamber.

The valve 48 is interposed in conduit means 50 which receives compressed gas and liquid discharged from the compressor through the passage 28. Although the valve is shown disposed in the compressor discharge conduit downstream of the compressor proper it is important to place the valve 48 as close to the discharge port 32 as possible in order to reduce the volume of the passage 28 and conduit 50 which is disposed between the port 32 and the valve. In this way the mass of fluid retained in the system during unloaded operation is reduced and the size of the chamber 42 required to obtain reasonably low unloaded power consumption is reduced. The conduit 50 leads to a combination liquid separator and reservoir tank 52 which also comprises a compressed gas receiver or storage means. Liquid free gas is conducted from the tank 52 by way of a conduit 54 to which may be connected a manual pressure relief or blowdown valve 56, and a power operated blowdown valve 58 the latter being operable to relieve the pressure in the tank 52 at a rate controlled by an orifice 59. Both valves 56 and 58 may be connected to discharge through a silencer 60. A pressure responsive minimum pressure valve 62 is interposed in conduit 55 and a pressure responsive pressure relief valve 64 is also in communication with the conduit 54. A manual control valve 66 may be interposed in the final discharge or service line portion of conduit 54.

Liquid is conducted from the tank 52 back to the compressor 10 by way of a conduit 68 in which are interposed a heat exchanger or cooler 70, a filter 72, and a two-position pilot operated valve 74. The valve 74 also is operable to control flow of liquid through an auxiliary liquid return line 76. In accordance with the operation of well known arrangements in liquid injected rotary compressors liquid is recirculated from the tank 52 back to the compressor for injection directly into the interior of the housing 14 and for circulation through the compressor bearings and other points requiring lubrication within the machine. The liquid is normally injected into the compressor at a location which is exposed to a pressure less than the working pressure in the tank 52 thereby providing a pressure differential between the tank and location of liquid injection into the compressor to assure flow as long as the valve 74 is open or in position *a*.

The compressor control system of FIG. 1 also includes a pilot pressure fluid conduit 77 leading from conduit 54 to valve 48 and having a solenoid operated two-position valve 78 interposed therein. A conduit 80 is connected to the conduit 77 and leads to the inlet valve 38. A solenoid operated two-position valve 82 is interposed in conduit 80. A pressure reducing valve 81 is also interposed in conduit 80. A further pilot control conduit 84 is in communication with discharge conduit 54 and the valve 82. A differential pressure control valve 86 is interposed in conduit 84 and a pressure switch 88 is in communication with conduit 84, also. The valve 86 is of a known type which at a first predetermined pressure in conduit 54 will produce a pressure signal to the valve actuator of valve 38, assuming valve 82 is in position *a*. As the pressure in conduit 54 increases above the first predetermined pressure the valve 86 operates to provide a progressively greater pressure signal to valve 38 which in response progressively moves toward a closed position to throttle inlet flow to the compressor 10.

Figure 3:
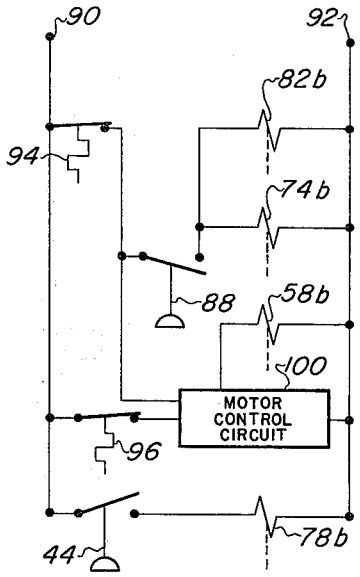
FIG. 3 is a schematic diagram of an electrical circuit which is part of the control system of FIG. 1.

Referring to FIG. 3, which is part of the control circuit of FIG. 1, an electrical control circuit is shown which includes a source of electric energy, not shown, which is imposed on the terminals 90 and 92. In circuit are the pressure switch 88 and the vacuum switch 44, the respective positions of which are shown in FIG. 1. The switch 88 is operable to energize solenoids 74*b*, and 82*b* which respectively comprise the actuators of valves 74 and 82. Vacuum switch 44, when closed, is operable to energize solenoid actuator 78*b* comprising the pilot operator for valve 78. The circuit of FIG. 3 also includes temperature responsive switches 94 and 96. As shown in FIG. 1 the switches 94 and 96 are disposed to be operable to sense the temperature of fluid flowing through the discharge conduit means of the compressor 10 at a suitable point upstream of valve 48.

The temperature switch 94 is operable, when opened on rising temperature, to deenergize solenoids 58*b*, 74*b*, and 82*b*. The temperature switch 96 is connected only to a motor control circuit generally designated by numeral 100 which is responsive to the opening of switch 96 on rising temperature to effect shutdown of the motor 12. The switch 96 would normally be set to open at a temperature greater than the temperature at which switch 94 would open. The solenoid 58*b* is also connected with the motor control circuit in such a way that when the motor 12 is deenergized by switch 96 or by other means, not shown, the solenoid 58*b* will be deenergized also. Normally, with the motor 12 running, solenoid 58*b* will only be responsive to switch 94.

The operation of the control system of FIGS. 1 and 3 is effected assuming that the compressor 10 is operated to run continuously whether loaded or unloaded although the system could be used with variable speed prime movers and also in conjunction with systems which would shut down the compressor from time to time. With the compressor 10 running under load, that is with a full throughput of working fluid, and with the discharge pressure in conduit 54 below the predetermined minimum which will cause valve 86 to provide a signal to valve 38 the valves 48, 74, 78, and 82 will be in position *a*, and valve 58 will be in position *b*. It is assumed also that valve 56 is closed and that valve 64 is set for relief of pressure in line 54 at a predetermined pressure in said line which is above the normal working and control pressures in the system. With the system of FIG. 1 progressive throttling of the compressor inlet gas flow is obtained prior to complete unloading or idling of the compressor. On reduced demand for compressed gas in line 54 and at a predetermined pressure therein valve 86 will commence delivery of a reduced pressure signal to the inlet valve 38 which pressure signal will proportionately increase as the pressure in line 54 increases all the while causing valve 38 to progressively throttle inlet flow to the compressor 10. As demand in line 54 is further reduced and at a predetermined pressure in conduit 84 the pressure switch 88 will close thereby energizing the solenoid actuators 74*b* and 82*b* for moving valves 74 and 82 to position *b*. With valve 82 in position b pressure gas at a controlled pressure, sufficient to close valve 38 completely, is conducted to the pilot operator of valve 38 thereby shutting off substantially all inlet gas flow to the compressor 10. Valve 74 has also shut off all liquid flow to the compressor 10 in position *b*. Alternatively, the solenoid actuator 78*b* could be placed in circuit with vacuum switch 44 whereby the shutoff of liquid flow to the compressor would be delayed until switch 44 closed.

The compressor 10, with valve 38 closed, will immediately commence to evacuate gas in chamber 42, and at a predetermined vacuum condition in chamber 42 the switch 44 will close thereby energizing solenoid actuator 78*b* to cause valve 78 to move to position *b*. Valve 78, in position b will conduct pressure fluid to valve 48 causing valve 48 to move to position b placing the compressor discharge passage 50 in communication with chamber 42 by way of conduit 46. The residual gas trapped in the rotor chambers 24 and the discharge passage 28 will expand into chamber 42 and recirculate through the compressor 10. If the chamber 42 is of sufficient size in relation to compressor displacement volume and the volume of the discharge passage 28 upstream of valve 48 the pressure in chamber 42 and the compressor may remain quite low and the power consumed by the compressor will accordingly be very low and mainly on the order of that necessary to overcome friction in the bearings, drive gearing, and seals.

Experiments with a helical screw compressor equipped with antifriction bearings but without timing gears have determined that the liquid (oil) normally present in the compressor at the time of liquid cutoff by closing valve 74 will be recirculated through the chamber 42 and back into the compressor and will be sufficient to provide adequate lubrication and cooling of the compressor rotors, bearings, and seals. The heat of compression of any gas remaining entrapped in the closed circuit comprising the compressor 10, the chamber 42, and the associated interconnecting conduits will largely be dissipated through the wall surfaces of the compressor and the chamber. However, if the temperature of the residual fluid pumped by the compressor during unloaded operation should increase beyond a desired maximum temperature the switch 94 will open causing solenoids 58*b*, 74*b*, and 82*b* to be deenergized. This action will result in valves 58, 74, and 82 moving to their positions *a*. The reduction in pressure in conduit 54 caused by the opening of valve 58 will result in a reduced pressure signal to inlet valve 38 causing the same to open. Hence, inlet gas flow to chamber 42 will cause the switch 44 to open deenergizing solenoid 78*b* and causing valves 78 and 48 to move to their positions *a*, respectively. Accordingly, the compressor 10 will commence operation in the loaded mode but with pressure gas discharging through the blowdown valve 58. This resumption of operation of the compressor in the working or loaded mode will be accompanied by the injection of copious amounts of oil to cool the compressor bearings and seals to a temperature below the temperature at which switch 94 opens.

As soon as the temperature in the compressor discharge passage decreases to a condition which will cause switch 94 to close, valve 58 will be energized to close and if the demand for compressed gas is still nil, the compressor will resume operation in the unloaded mode as described above once the pressure in lines 54 and 84 have increased sufficiently to actuate pressure switch 88.

Moreover, if the vacuum condition in chamber 42 is lost such as by a leaking inlet valve 38 or the valve 48 the recirculation of an increasing amount of fluid in the circuit formed by the compressor 10, the chamber 42, and the interconnecting conduits will eventually result in a temperature increase great enough to actuate switch 94 to open. Accordingly, valves 58, 74, 78, and 82 will be moved to position *a* until a normal temperature condition in the compressor discharge passage is resumed.

When the demand for compressed gas in conduit 54 is sufficient to cause a drop in pressure which will open switch 88 solenoid actuators 74*b* and 82*b* will be deenergized to cause the respective valves 74 and 82 to return to positions *a*, respectively. As soon as residual pressure in the pilot actuator of inlet valve 38 is relieved the valve will open causing an increase in pressure in the chamber 42 and resulting in the opening of switch 44 and deenergization of solenoid actuator 78*b*. Accordingly, valves 78 and 48 will now return to position *a* and the compressor 10 will resume operating to compress gas and discharge a gas-liquid mixture into the tank 52.

Figure 4:
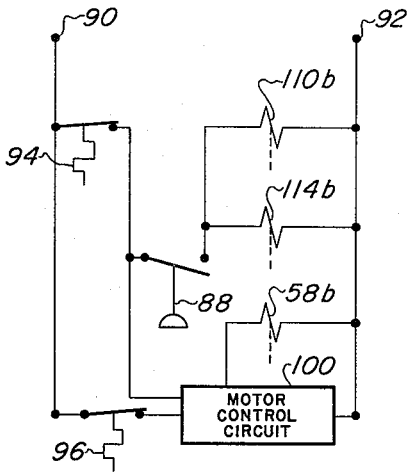
FIG. 4 is a schematic diagram of an electrical circuit which is part of the control system of FIG. 2; and, FIG. 5 is a longitudinal section view of a helical screw gas compressor of a type which may be advantageously used with the control system of the present invention.

The compressor system shown in FIGS. 2 and 4 is similar in some respects to the system shown in FIGS. 1 and 3. Like elements are designated with the same numerals. The valve 82 of FIG. 1 has been replaced by a solenoid actuated valve 110 shown in FIG. 2 having a solenoid actuator 110*b*. The valve 110 is shown as a single unit having two sets of position symbols. In effect valve 110 is the equivalent of two separate valves connected in such a way so as to shift from position *a* to position *b* together.

Furthermore, the control system of FIGS. 2 and 4 also includes a pneumatic time delay device, generally designated by the numeral 112, which is connected to valve 110 and to the pilot actuator of the valve 48. As shown in the schematic diagrams of FIGS. 1 and 2 the auxiliary liquid return line 76 leads from a chamber 53 within the receiver-separator tank 52 to the compressor 10. The line 76 conducts liquid from the chamber 53 which has collected on a filter element 55 and pooled at the bottom of the chamber. In the embodiment of FIG. 2 a two-position solenoid operated valve 114 is interposed in the line 76 and is actuated to the closed position when the solenoid actuator 114*b* is energized. The main liquid return line 68 leads from the liquid reservoir portion of the tank 52 to the compressor 10 and includes a two-position pilot pressure fluid actuated valve 116 interposed for interrupting the flow of liquid when the valve is actuated to position b. The pilot actuator of the valve 116 is connected to receive pressure fluid from the time delay device 112. In this way the control system of FIGS. 2 and 4 operates to delay the interruption of the main flow of liquid to the compressor 10 until the valve 48 has shifted to position *b* also. By delaying the shifting of valve 116 a sufficient amount of liquid is injected into the compressor working chambers to provide a sealing and cooling medium for effecting a more complete and more rapid evacuation of the chamber 42 after the valve 38 has been closed and before the valve 48 is shifted to position *b*.

Referring particularly to FIG. 4 the electrical control circuitry shown is similar to that of FIG. 3. However, the solenoids 74*b* and 82*b* of FIG. 3 have been replaced by the solenoids 114*b*, and 110*b*. Moreover, the vacuum switch 44 of FIG. 3 has been eliminated in the control circuit of FIGS. 2 and 4.

With the control system of FIGS. 2 and 4 the compressor will be placed in the unloaded or idling mode upon actuation of switch 88 which will, when closed, energize the solenoid 110*b* to shift valve 110 to position *b*, both sections of valve 110 included. This action will result in the closing of the compressor intake valve 38 and the communication of a pressure signal to the time delay device 112. The closing of pressure switch 88 also will energize the solenoid actuator of valve 114 moving said valve to position *b* to shut off the flow of fluid from chamber 53 to the compressor 10. After a suitable time delay, which may be adjusted in the device 112 by adjusting the size of the variable orifice 113 and by adjusting the pressure at which the self-actuating valve 115 opens, pressure air or gas will actuate valve 48 and 116 to position *b* connecting the compressor discharge conduit 50 to the chamber 42, and interrupting liquid flow to the compressor by way of line 68. The time delay device 112 may be adjusted to cause the valve 48 and 116 to move to position *b* only after the chamber 42 has been suitably evacuated.

When the pressure in line 54 decreases for any reason sufficiently to cause switch 88 to open, valves 110 and 114 will be returned to position *a*, resulting in the opening of the compressor intake valve 38 and the shifting of valves 48 and 116 to position *a* as well. The compressor 10 will thus begin operating in the working mode to either supply compressed gas to service line 54 or to be vented through valve 58 until the compressor is cooled sufficiently to return to an idling operating mode.

As may be appreciated from the foregoing the control circuits of FIGS. 1 through 4 could be altered to use fluid pressure operated elements where many of the electrical elements are shown and vice versa. Moreover, the control systems of FIGS. 1 through 4 might also be modified to provide for direct load to idle operation without progressive throttling by eliminating valve 86 and making pressure switch 88 responsive to pressure in line 54 directly. As previously mentioned, the control system of the present invention could be adapted to operate compressor apparatus in closed cycle gas compression systems such as vapor-compression refrigeration systems as well as compressors operating on other gases. For operation in refrigeration systems the control circuit might be modified to include temperature responsive sensing devices for controlling the load or idle mode of operation of the compressor.

The selection of the size or volume of the chamber 42 is of importance and as previously mentioned is somewhat dependent on the placement of the valve 48 with respect to the discharge port 32 in order to minimize the amount of residual gas trapped in the compressor. The total volume of the chamber 42 is usually considered to include the volume of the inlet conduit 34 between the chamber and the inlet port 26, which volume includes the interior space 25, and the volume of the conduit 46 between the valve 48 and the chamber itself. This volume should be at least equal to the displacement volume of the compressor and preferably more than approximately twice the displacement volume of the compressor for better idling power consumption. The displacement volume of a helical screw compressor is normally regarded as the swept volume of the chambers formed by the intermeshing rotors in one complete cycle of emptying all chambers, and is usually based on the sum of the swept volumes of all chambers which are emptied as a result of one revolution of the main rotor, such as the rotor 16 of the compressor 10. In the case of rotary vane compressors or the like displacement volume is that which is ordinarily accomplished with one revolution of the rotor.

What is claimed is:

1. In a gas compressor apparatus:

a positive displacement rotary gas compressor including a gas inlet port and a gas discharge port;

an inlet conduit in communication with said inlet port;

a discharge conduit means in communication with said discharge port and a compressed gas receiver;

an inlet valve for closing off the flow of inlet gas into said inlet conduit;

means defining a chamber in communication with said inlet conduit between said inlet valve and said inlet port;

valve means interposed in said discharge conduit means between said discharge port and said receiver and operable to interrupt the flow of gas from said discharge port to said receiver and place said discharge port in fluid flow communication with said chamber; and, control means for operating said inlet valve to close off the flow of inlet gas into said compressor and upon substantial evacuation of gas from said chamber operating said valve means to place said discharge port in communication with said chamber whereby the power consumed by said compressor is reduced.

2. The invention set forth in claim 1 wherein:

said control means includes means responsive to a decreasing demand for compressed gas from said compressor for actuating said inlet valve to close off the flow of inlet gas to said compressor.

3. The invention set forth in claim 2 wherein:

said means responsive to decreasing demand for compressed gas comprises a pressure sensing switch.

4. The invention set forth in claim 2 wherein:

said control means includes pressure sensing means responsive to a predetermined decrease in fluid pressure in said chamber for causing said valve means to operate to place said discharge port in communication with said chamber for discharging residual gas entrapped in said compressor into said chamber.

5. The invention set forth in claim 2 wherein:

said control means includes a time delay device responsive to the closing of said inlet valve for providing a signal to operate said valve means after a predetermined time period commencing with a signal initiating the closing of said inlet valve.

6. The invention set forth in claim 2 wherein:

said control means includes a power operated valve for relieving the pressure in said discharge conduit means downstream of said valve means.

7. The invention set forth in claim 6 wherein:

said control means includes temperature sensing means for sensing the temperature of gas discharging from said compressor and for effecting the operation of said power operated valve to reduce the fluid pressure in said discharge conduit means in response to a predetermined temperature of said gas discharging from said compressor.

8. The invention set forth in claim 6 wherein:

said compressor apparatus includes means for injecting liquid into said compressor including liquid conduit means for conducting liquid to said compressor, and said compressor apparatus further includes a shutoff valve interposed in said liquid conduit means for interrupting the flow of liquid to said compressor.

9. The invention set forth in claim 8 wherein:

said shutoff valve is power operated and is responsive to the actuation of said means responsive to decreasing demand for compressed gas to substantially interrupt the flow of liquid to said compressor.

10. The invention set forth in claim 8 wherein:

said shutoff valve includes a power actuator which is in circuit with said control means and is operable in response to a control signal to said valve means to interrupt the flow of liquid to said compressor.

11. The invention set forth in claim 1 wherein:

said compressor is of the helical screw type including a housing and a pair of intermeshing helical rotors disposed in said housing to form a plurality of variable volume chambers for entrapping and compressing gas admitted to said housing through said inlet port.

12. The invention set forth in claim 1 wherein:

the volume of said means defining said chamber is at least equal to the displacement volume of said compressor.

13. The invention set forth in claim 1 wherein:

the volume of said means defining said chamber is more than twice the displacement volume of said compressor.

* * * * *